United States Patent [19]

Riffe

[11] 4,245,966

[45] Jan. 20, 1981

[54] RECIPROCATING PISTON DEVICE WITH CHANGEABLE STROKE LENGTH

[75] Inventor: Delmar R. Riffe, Murrysville, Pa.

[73] Assignee: Westinghouse Electric Corp., Pittsburgh, Pa.

[21] Appl. No.: 873,295

[22] Filed: Jan. 30, 1978

[51] Int. Cl.[3] ..... F04B 49/00; F04B 39/00; F01B 31/00

[52] U.S. Cl. ..... 417/539; 74/571 R; 92/13.4

[58] Field of Search ..... 417/534–538, 417/521; 74/571; 92/13.4, 13.5, 13.7

[56] References Cited

U.S. PATENT DOCUMENTS

| | | | |
|---|---|---|---|
| 1,212,791 | 1/1917 | Manly | 417/315 |
| 1,908,612 | 5/1933 | Johnson | 417/315 |

*Primary Examiner*—William L. Freeh

*Attorney, Agent, or Firm*—E. C. Arenz

[57] ABSTRACT

In a device such as a refrigerant compressor provided with a reciprocating piston having a stroke length which can be changed from one value to another in accordance with the direction of rotation of the crankshaft driving a connecting rod, there is provided an arrangement in which the top deadcenter position of the piston can be maintained irrespective of the changes in stroke length by an eccentric ring which has limited rotation on the crankshaft crankpin, and a second eccentric ring encompassing the first eccentric ring and which has limited rotation relative to the encompassing strap end of the connecting rod. With this arrangement, both the throw of the crankpin means and the effective length of the connecting rod are generally concurrently changed inversely when the crankshaft rotates in one direction or alternatively in the other direction.

8 Claims, 4 Drawing Figures

RECIPROCATING PISTON DEVICE WITH CHANGEABLE STROKE LENGTH

CROSS REFERENCE TO RELATED APPLICATION

Sisk, U.S. patent application Ser. No. 873,291, filed Jan. 30, 1978 is a related application in that it describes an arrangement for a dual capacity refrigerant compressor in which stroke length is automatically changed in accordance with reversal of the compressor motor direction, the Sisk arrangement differing from mine in that in his arrangement both the top and bottom deadcenter positions of the piston change with the change in stroke length.

BACKGROUND OF THE INVENTION

1. Field of the Invention

The invention pertains to the art of reciprocating piston devices in which the stroke length of the piston in a cylinder is changed from one value to another, the device being considered to be particularly applicable for use in refrigerant compressors for air conditioning and heat pump applications. A short discussion of the reasons for the desirability of an arrangement such as Sisk proposes is set forth in his related application to which reference should be had.

2. Prior Patent Art Description

The prior patents which are closest in one way or another to the related Sisk arrangement are set forth by way of representative examples and discussed in the related Sisk application. To the best of my knowledge, these are also the closest patents with respect to my arrangement, but I do not consider any of them to be particularly pertinent.

SUMMARY OF THE INVENTION

In accordance with the invention, an arrangement is provided to obtain top deadcenter positions of predetermined relation irrespective of the changes in stroke length of a reciprocating piston device, where the stroke length is changed by rotating a crankshaft in one direction and the opposite direction alternatively. The arrangement includes means responsive to crankshaft rotation to establish the effective eccentricity of crankpin means of the crankshaft at a lesser and at a greater value in accordance with the rotation of the crankshaft in one direction and the other direction, and means responsive to the crankshaft rotation to also establish an effective length of the connecting rod at a greater value and at a lesser value in accordance with the rotation of the crankshaft in the one direction and the other direction, respectively, the change in value of the eccentricity of the crankpin and the change in value of the effective length of the connecting rod occurring generally concurrently. In what is currently considered the preferred embodiment the top deadcenter position will remain the same irrespective of the direction of crankshaft rotation.

The means to accomplish the change in crankpin means eccentricity comprises a first eccentric ring rotatably mounted on a crankpin with means limiting the rotation of the eccentric ring relative to the crankpin, and the means to obtain the change in effective connecting rod length comprises a second eccentric ring mounted and freely rotatable on the first eccentric ring with the second eccentric ring being encompassed in rotatable relation by the strap end of the connecting rod and with means provided to limit rotation of the second eccentric ring relative to the strap end.

DRAWING DESCRIPTION

DESCRIPTION OF THE PREFERRED EMBODIMENT

Figure 1:
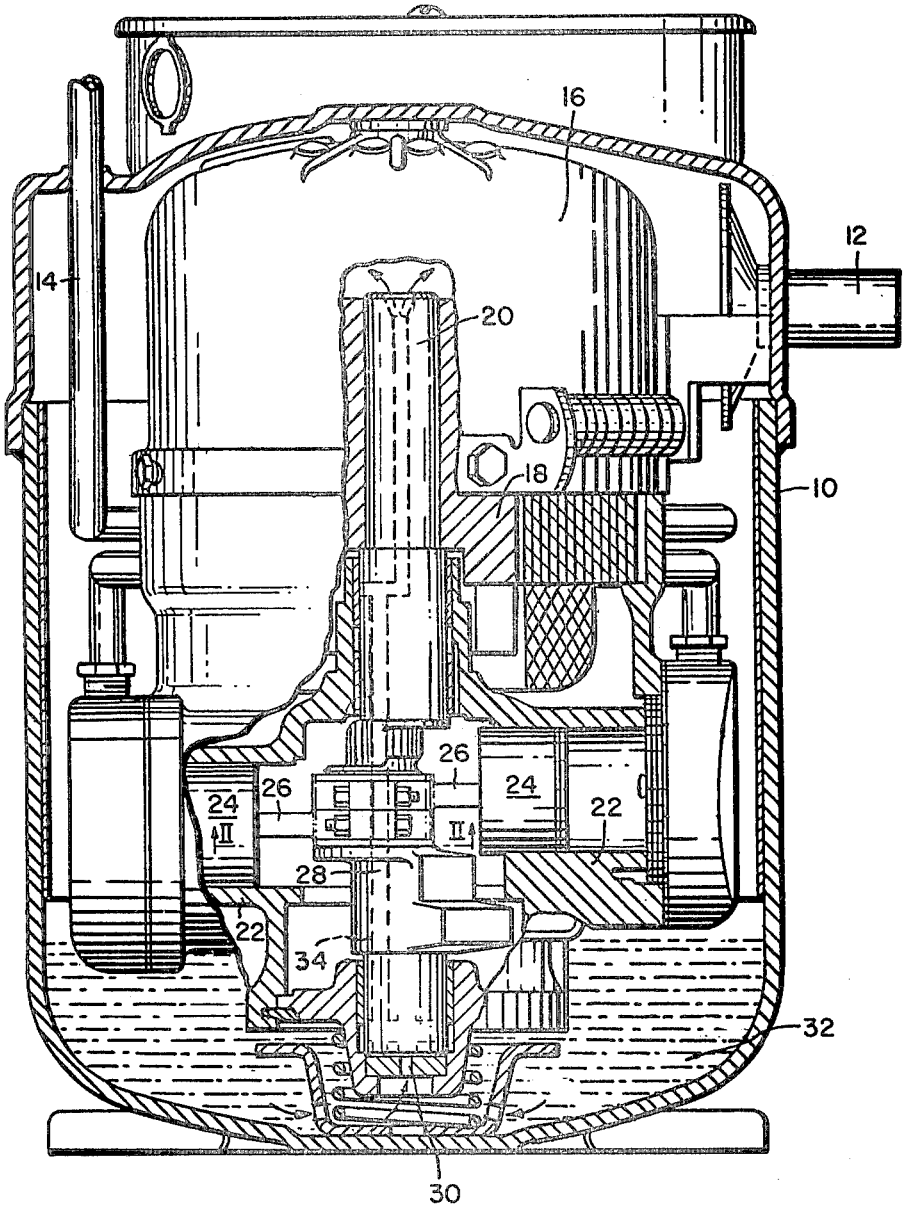
FIG. 1 is a partly broken side view of a hermetic refrigerant compressor representative of the type device to which I consider my invention particularly applicable, with the shell shown in cross section and certain parts being broken.

While the invention is considered applicable to various reciprocating piston devices in which the stroke length of the piston in a cylinder is changed from one value to another in accordance with the direction of rotation of the crankshaft driving a connecting rod, it is thought currently that one of its most useful immediate applications is in a hermetic refrigerant compressor having either single or multiple cylinders. Thus, for purposes of describing and illustrating the invention, a hermetic refrigerant compressor which is representative of the type to which the invention may be applied is illustrated in FIG. 1. That compressor in many respects is generally the same as the one shown in the copending Sisk application, and as described in U.S. Pat. No. 3,259,807 to which reference should be had for an explanation of the overall structure of the compressor. However, a brief description of some of the basic parts of the compressor will be here made to promote an understanding of the way in which the invention may be incorporated in the compressor.

Referring to FIG. 1, the generally cylindrical, hermetically sealed shell 10 has an inlet 12 through which the suction gas refrigerant is admitted to the shell, and one or more discharge gas tubes 14 through which the compressed gas exits from the shell. The upper part of the shell houses a reversible electric motor 16 whose rotor 18 is fixed to the upper end of the crankshaft 20 to rotate the crankshaft in one direction or the other direction depending upon the direction of rotation of the rotor. In the illustrated unit the compressor has two cylinders 22 in which the two pistons 24 reciprocate as they are driven by the connecting rods 26 which of course have their one ends connected to the pistons and their other strap ends rotatably coupled to that lower portion 28 of the crankshaft which is provided with the crankpin means of the crankshaft.

The extreme lower end portion of the crankshaft 28 includes lubricant inlet means 30 for admitting oil from the sump 32 into a vertically extending passage 34 in the crankshaft to carry oil to the bearings and so on as is detailed in the noted earlier patent on the compressor.

Figure 2:
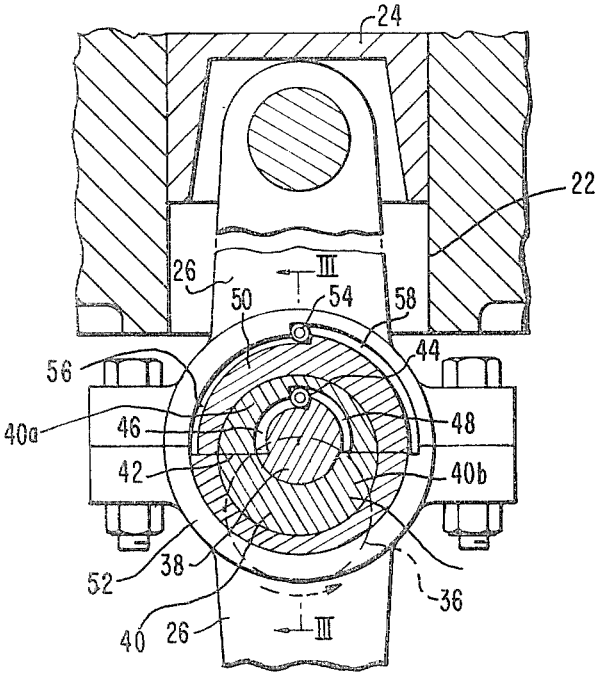
FIG. 2 is a partly broken section corresponding to one taken along the line II—II of FIG. 1.
Figure 3:
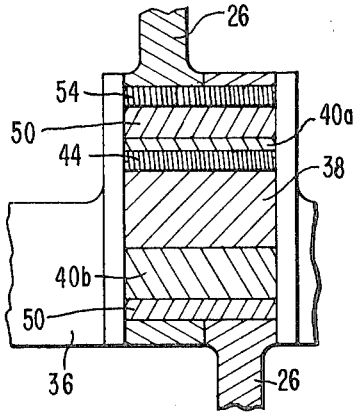
FIG. 3 is a fragmentary section corresponding to one taken along the line III—III of FIG. 2.
Figure 4:
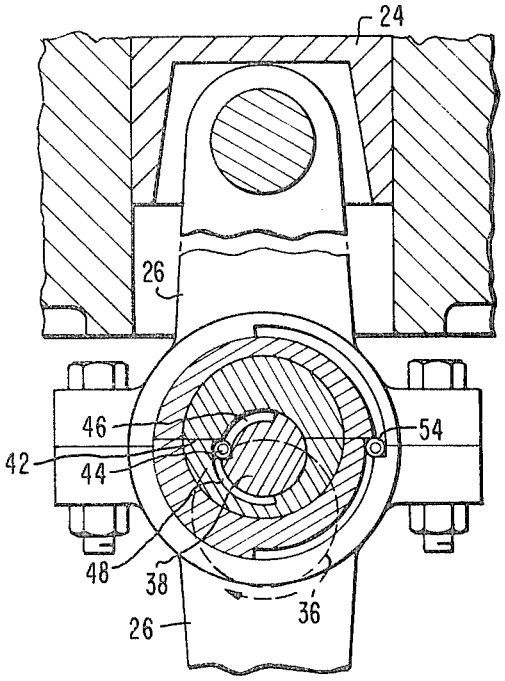
FIG. 4 is a view as in FIG. 2 but with the parts in a position obtained when the crankshaft is driven in a direction opposite to the direction of FIG. 2.

Referring now to FIGS. 2–4, the dash line circles 36 in FIGS. 2 and 4 indicate the location of the part of the crankshaft 28 which is journalled in the main bearings while the small, generally circular part 38 is the part of the crankpin means which is fixed or integral with the crankshaft. A first eccentric ring 40, which derives its eccentricity from the progressively varying wall thickness is mounted on the part 38 of the crankpin means in rotatable relation therewith. In the illustrated embodiment the ring comprises an upper part 40*a* and a lower part 40*b* separated by the parting lines 42 at diametrically opposite sides of the part 38 to permit the eccentric ring 40 to be mounted on the part 38. The part 38 and the first eccentric ring 40 together comprise the crankpin means of the invention since it is the outer circumference of the first eccentric ring 40 which provides the bearing surface upon which the strap end assembly of the connecting rod rotates.

In the embodiment shown in FIGS. 2–4, the means limiting the rotation of the first eccentric ring relative to the part 38 comprises means located at the interface of the eccentric ring 40 inner circumference and the fixed crankpin part 38 outer circumference. This limiting means includes a key 44 which extends axially in one relieved area 46 extending along an arcuate portion of the outer circumference of the fixed crankpin part 38, and another relieved area 48 extending along an arcuate portion of an inner circumference of the first eccentric ring, the depth of the two relief areas each equaling half of the diameter of the key 44 which is interposed in the space formed between the two relief areas.

Still referring to FIGS. 2–4, a second, larger eccentric ring 50 encompasses the first eccentric ring 40 in freely rotatable relation and is in turn encompassed on its circumference by the strap end 52 of the connecting rod 26. The second eccentric ring is rotatable within the strap end to a limited degree, the means limiting the rotation comprising means located at the interface of the second ring and strap end and including a key 54, the arcuate relieved area 56 in the outer circumference of the second ring, and the arcuate relieved area 58 in the inner circumference of the strap end. The general arrangement of the key and the relieved areas for the second ring and strap end is basically the same as the arrangement for the crankpin and first ring.

In FIG. 2, the parts are shown in their angular relationships which obtains when the crankshaft is rotating in a counterclockwise direction, while in FIG. 4 the angular relationships shown are those obtained when the crankshaft rotates in a clockwise direction. In both views the crankshaft and parts are shown with the piston in a top deadcenter position. In FIG. 2, the effective throw of the crankpin means is at its shortest, while the effective length of the connecting rod is the maximum. In FIG. 4, the relationship is reversed with the effective eccentricity of the crankpin means being at its maximum and the effective length of the connecting rod being at its minimum. If the radial dimension of the narrowest part of the wall of each of the eccentric rings is the same, and the radial dimension of the thickest part of the wall of the two eccentric rings is the same, then the same top deadcenter position of the piston will be obtained irrespective of whether the parts are as shown in FIG. 2 or as in FIG. 4. This is the preferred arrangement as currently contemplated. However, it is not believed that these dimensional relationships of the two rings are mandatory and they may be dimensioned so that either the crankpin means throw or the connecting rod length can have a change in value upon a reveral of motor direction which differs from each other. Thus the top deadcenter positions upon a change in stroke length will have a predetermined relation, with the currently preferred arrangement being that the change in value of the effective eccentricity of the crankpin means is substantially equal to the change in value of the effective length of the connecting rod.

The purpose of course for reducing stroke length in a refrigerant compressor is to change the capacity of the compressor and the discussion of the advantages of the dual capacity obtained by stroke length change set forth in the copending Sisk application are equally applicable to an arrangement according to my invention. Also, the control arrangement disclosed and claimed in the Sisk application is also applicable to a compressor having my arrangement.

The example of stroke reduction in the Sisk application is given as 30% which, with a high capacity stroke length of unity and a clearance ratio of 5% gives a new clearance ratio for the reduced stroke length of about 28.6%.

With my arrangement, and again assuming a high capacity stroke length of unity and an initial clearance ratio of 5%, to get a reduction of capacity of about the same order as Sisk in my arrangement the stroke reduction is 60% as contrasted to Sisk's 30%. This results in a new clearance ratio with the reduced stroke length of 12.5%. Since with my arrangement it requires a greater reduction in stroke to get the same capacity reduction, this greater reduction in stroke results in a larger reduction in piston speed and correspondingly a larger reduction in the piston friction losses. In at least that respect, I consider my arrangement to be superior to that disclosed in the Sisk application. I also consider it desirable to maintain a small volumetric clearance to keep reexpansion losses relatively low.

The rate at which the eccentric rings rotate when the electric motor of the compressor is reversed is not important except when switching from one direction to another the length which is increasing must not increase faster than the length which is decreasing at the same time, because of the possibility of the piston striking the cylinder head or valve assembly in the head.

Fortuitously with the arrangement of the invention, the tendency is for the element which is increasing to increase at a slower rate than the element which is decreasing. This is a result of the piston working against a load in the compression stroke which tends to retard a lengthening dimension of an element. For example, with the arrangement as shown in FIG. 2 in which the crank throw is at the minimum and with the connecting rod at the maximum, when the motor is reversed to move toward a relationship of parts as shown in FIG. 4, the tendency is for the connecting rod to move toward its effectively shorter length faster than the crank throw will move toward its effectively longer length since the load on the piston automatically gives that result. In that sense, an analogy might be that rotating the eccentric rings in a direction to give an effectively increased dimension is equivalent to sliding a load up an inclined plane, but in rotating the eccentric rings in the other direction of decreased effective length is equivalent to sliding a load down an inclined plane. It may also be found desirable as generally set forth in the Sisk application to port lubricant from the compressor into the arcuate spaces to dampen the rate of rotation.

I claim:

1. In a reciprocating piston device in which stroke length of the piston in a cylinder is changed from one value to another in accordance with the direction of rotation of the crankshaft driving a connecting rod, an arrangement for obtaining top deadcenter positions of predetermined relation irrespective of the changes in stroke length when the crankshaft rotates in one direction and the other, comprising:

means responsive to crankshaft rotation to establish the effective eccentricity of crankpin means of the crankshaft at a lesser and at a greater value in accordance with rotation of the crankshaft in one direction and the other direction, respectively; and means responsive to crankshaft rotation to establish an effective length of the connecting rod, generally concurrently with the establishment in effective eccentricity of the crankpin means, at a greater value and at a lesser value in accordance with rotation of the crankshaft in said one direction and said other direction, respectively.

2. An arrangement according to claim 1 wherein:

the change in value of effective eccentricity of said crankpin means is substantially equal to the change in value of the effective length of said connecting rod so that a predetermined top deadcenter position is substantially maintained with said changes in value.

3. An arrangement according to claim 1 wherein:

said effective eccentricity establishing means comprises a first eccentric ring rotatably mounted on a crankpin with means limiting rotation of said eccentric ring relative to said crankpin.

4. An arrangement according to claim 3 wherein:

said effective connecting rod length establishing means comprises a second eccentric ring mounted and freely rotatable on said first eccentric ring, said second eccentric ring being encompassed in rotatable relation by the strap end of said connecting rod, and means are provided to limit rotation of said second eccentric ring relative to said strap end.

5. An arrangement according to claim 4 wherein:

said means limiting rotation of said first eccentric ring relative to said crankpin and said means limiting rotation of said second eccentric ring relative to said strap end both comprise oppositely open arcuate recesses at the interfaces of the relatively rotatable memebers, and key means in said recesses.

6. In a dual capacity hermetic refrigerant compressor of the reciprocating piston type in which stroke length of the piston in a cylinder is changed from one value to another in accordance with the direction of rotation of the crankshaft driving a connecting rod, an arrangement for obtaining top deadcenter positions of predetermined relation irrespective of the changes in stroke length when the crankshaft rotates in one direction and the other, comprising:

means responsive to crankshaft rotation to establish the effective eccentricity of crankpin means of the crankshaft at a lesser and at a greater value in accordance with rotation of the crankshaft in one direction and the other direction, respectively; and means responsive to crankshaft rotation to establish an effective length of the connecting rod, generally concurrently with the establishment in effective eccentricity of the crankpin means, at a greater value and at a lesser value in accordance with rotation of the crankshaft in said one direction and said other direction, respectively.

7. An arrangement according to claim 6 wherein:

the change in value of effective eccentricity of said crankpin means is substantially equal to the change in value of the effective length of said connecting rod so that a predetermined top deadcenter position is substantially maintained with said changes in value.

8. An arrangement according to claim 6 wherein:

said effective eccentricity establishing means comprises a first eccentric ring rotatably mounted on a crankpin with means limiting rotation of said eccentric ring relative to said crankpin;

said effective connecting rod length establishing means comprises a second eccentric ring mounted and freely rotatable on said first eccentric ring, said second eccentric ring being encompassed in rotatable relation by the strap end of said connecting rod, and means are provided to limit rotation of said second eccentric ring relative to said strap end; and said means limiting rotation of said first eccentric ring relative to said crankpin and said means limiting rotation of said second eccentric ring relative to said strap end both comprise oppositely open arcuate recesses at the interfaces of the relatively rotatable members, and key means in said recesses.

* * * * *